US005477910A

United States Patent [19]

Bijaoui et al.

[11] Patent Number: 5,477,910

[45] Date of Patent: Dec. 26, 1995

[54] PROCESS AND DEVICE FOR OBTAINING A WIRE MADE OF AMORPHOUS METAL ALLOY HAVING AN IRON BASE

[75] Inventors: Denis Bijaoui, Aubiere; Guy Jarrige, Cournon D'Auvergne; Michel Legras, Beauregard-L'Eveque; Jean Roche, La Roche-Blanche, all of France

[73] Assignee: Compagnie Generale des Etablissements Michelin - Michelin & Cie, Clermont Ferrand Cedex, France

[21] Appl. No.: 142,374

[22] PCT Filed: May 22, 1992

[86] PCT No.: PCT/FR92/00458

§ 371 Date: Nov. 23, 1993

§ 102(e) Date: Nov. 23, 1993

[87] PCT Pub. No.: WO92/21460

PCT Pub. Date: Dec. 10, 1992

[30] Foreign Application Priority Data

May 27, 1991 [FR] France ..... 91 06370

[51] Int. Cl.[6] ..... B22D 11/00

[52] U.S. Cl. ..... 164/463; 164/462; 164/423

[58] Field of Search ..... 164/462, 463, 164/423, 475, 415, 46, 271

[56] References Cited

U.S. PATENT DOCUMENTS

| | | | |
|---|---|---|---|
| 4,473,401 | 9/1984 | Masumoto et al. | 75/126 |
| 4,495,691 | 1/1985 | Masumoto et al. | 29/527.5 |
| 4,506,023 | 3/1985 | Guigonis | 501/104 |
| 4,523,626 | 6/1985 | Masumoto et al. | 164/463 |
| 4,566,525 | 1/1986 | Li et al. | 164/463 |
| 4,573,520 | 3/1986 | Fournier et al. | 164/253 |
| 4,614,221 | 9/1986 | Masumoto et al. | 164/462 |
| 4,741,464 | 5/1988 | Pinkerton | 222/598 |

FOREIGN PATENT DOCUMENTS

| | | | |
|---|---|---|---|
| 0055827 | 7/1982 | European Pat. Off. | 164/423 |
| 0096551 | 12/1983 | European Pat. Off. . | |
| 360-104A | 3/1990 | European Pat. Off. | 164/462 |
| 63-10044 | 1/1988 | Japan . | |
| 1-27742A | 1/1989 | Japan | 164/462 |
| 1-150449 | 6/1989 | Japan . | |
| 1-271040 | 10/1989 | Japan . | |

OTHER PUBLICATIONS

Dissertation an der FakultaT FuR Bergbau, Huttenwesen und Geowissenschaften der Rwth–Aachen, Dec. 1985, W. K. Hug: "Keimbildung und Kristallisation in rasch erstarrten, Eisen–Bor–Basislegierungen"* p. 17, FIG. 4.2*.

*Primary Examiner*—P. Austin Bradley
*Assistant Examiner*—I. H. Lin
*Attorney, Agent, or Firm*—Brumbaugh, Graves, Donohue & Raymond

[57] ABSTRACT

A process and device for producing a wire (12) made of amorphous metal alloy having an iron base by producing a jet (7) of molten alloy (4) through the orifice (60) of a die (6), and introducing this jet (7) into a cooling liquid (9) urged by centrifugal force against the inner wall of a rotary drum. The crucible (2) containing the alloy (4) and the die (6) are made using different materials and are joined by a joint (25) the material of which differs from those of the crucible (2) and of the die (6). Furthermore, means (3) are employed for heating the alloy (4) both in the crucible (2) and in the die (6) and an inert or reducing gas is delivered directly in contact with the jet (7) as it leaves the die (6). Wire (12) obtained with this process or this device, this wire being employed, for example, for reinforcing pneumatic tires.

28 Claims, 3 Drawing Sheets

PROCESS AND DEVICE FOR OBTAINING A WIRE MADE OF AMORPHOUS METAL ALLOY HAVING AN IRON BASE

BACKGROUND OF THE INVENTION

The invention relates to a process and device making it possible to obtain wires made of amorphous metal alloys by rapid cooling in a liquid medium, these alloys having an iron base.

It is known to make use of a process of hyperquenching by directing a jet of iron-based, amorphizable molten alloy into a liquid cooling layer, for example a layer of water, held by virtue of centrifugal force against the inner wall of a rotary drum. This process is commonly called "in rotating water spinning" (spinning into water in rotation), although it is not restricted to the use of water as cooling fluid, the latter process being often referred to by the abbreviation "INROWASP", a term which will be employed herein, given its very frequent use in technical literature.

The INROWASP process makes it possible to obtain amorphous fine wires, highly resistant to corrosion, which have a tensile breaking load that can reach or even exceed 3200 MPa.

Such a process is described, for example, in U.S. Pat. Nos. 4,495,691, 4,523,626, and 5,392,838.

However, at present this process exhibits the following disadvantages:

- high wear of the orifice through which the molten alloy is poured takes place, this being even after only a few minutes pouring;
- if it is desired to reduce the number of breaks of the jet or of the quenched wire during the pouring, it is preferable to have a low value of the angle of incidence of the jet in relation to the circumferential direction of the cooling liquid, this value being, for example, between 40° and 70° ;
- furthermore, to prevent the jet of liquid metal beginning to break up into droplets before its contact with the cooling liquid, it is necessary for the distance between this liquid and the die orifice to be very small, for example equal to 5 mm, or even less;
- these two conditions are very difficult to implement because of the bulkiness of the devices used to heat the alloy and to spin it;
- with some compositions, the oxidation of the liquid jet is very fast from the moment it leaves the die; this oxidation results in considerable wetting of the outer part of the die by the oxide formed, giving rise to perturbations in the flow and, consequently, frequent breaks of the jet and of the wire, this being even with a short distance between the die exit and the cooling liquid;
- the above-mentioned problems associated with bulkiness, and the need to have a short distance between the pouring orifice and the cooling liquid, mean that it is very difficult to heat the liquid metal efficiently at the pouring orifice; it is then necessary to bring about an overheating of the liquid alloy, before it passes through the die, in order that it may remain liquid when discharged, but this overheating can cause hydrodynamic instabilities of the jet and can result in a poor surface quality of the wire obtained after quenching, or even a wire which is more sensitive to thermal embrittlement.

Japanese patent application published under No. 63-10044 describes a process in which an inert or slightly reducing protective gas is delivered into an enclosure surrounding the pouring crucible. However, this protective enclosure results in a considerable bulkiness which does not allow the pouring orifice to be heated efficiently, and the overheating of the amorphizable alloy cannot therefore be avoided. Furthermore, the protective gas is not localized at the pouring orifice and the protection of the jet is therefore not satisfactory.

Japanese patent application published under No. 1-271040 describes a process in which the heating of the amorphizable alloy in the top part of the crucible is produced with the aid of a first induction coil powered with an intermediate frequency current, and the heating at the bottom of the crucible is ensured by a second induction coil powered by a high frequency current. This device is characterized by a great complexity of the heating means, the proximity of the two induction circuits at different frequencies also being capable of giving rise to undesirable effects where the generators are concerned, as a result of the phenomenon of the coupling between the two circuits.

SUMMARY OF THE INVENTION

The aim of the invention is to avoid these disadvantages.

The invention consequently relates to a process for producing a wire made of amorphous metal alloy having an iron base, this process consisting in producing a jet of a molten amorphizable alloy through the orifice of a die and in introducing the jet into a cooling liquid urged by centrifugal force against the inner wall of a rotary drum, this process being characterized by the following points:

a) a crucible containing the alloy and a die arranged at one of the ends of the crucible are employed; the crucible and the die are made of different materials and are joined by a joint the material of which differs from those of the crucible and of the die;

b) means for heating the alloy are employed both in the crucible and in the die;

c) an inert or reducing gas is delivered directly in contact with the jet as it leaves the die.

The invention also relates to a device for obtaining a wire made of amorphous metal alloy having an iron base, this device comprising a crucible capable of containing an amorphizable alloy in the liquid state, having an iron base, a die arranged at one end of the crucible, means enabling a pressure to be applied to make the liquid alloy flow through the die orifice in the form of a jet and in the direction of a cooling liquid, a drum, and means enabling the drum to be rotated about an axis so as to maintain the cooling liquid in the form of a layer against the inner wall of the drum, so as to produce the amorphous wire by rapid solidification of the jet, the device being characterized by the following points:

a) the crucible and the die are produced using different materials and are connected by a joint the material of which differs from those of the crucible and of the die;

b) the device comprises means for heating the alloy both in the crucible and in the die;

c) the device comprises means for delivering an inert or reducing gas directly in contact with the jet as it leaves the die.

The invention also relates to the amorphous wires obtained with the process or the device which are in accordance with the invention. These wires can be employed, for example, for reinforcing plastic or rubber articles, especially pneumatic tires, and the invention also relates to these articles.

The examples of embodiment which follow and the entirely diagrammatic figures of the drawing corresponding to these examples are intended to illustrate the invention and to make it easier to understand without, however, limiting its scope.

DESCRIPTION OF PREFERRED EMBODIMENTS

Figure 2:
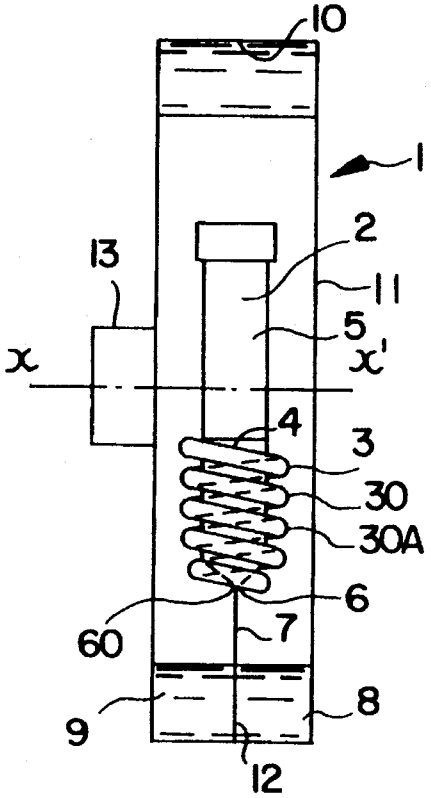
FIG. 2 shows the device of FIG. 1 in a sectional view taken in a plane containing the axis of the drum.
Figure 1:
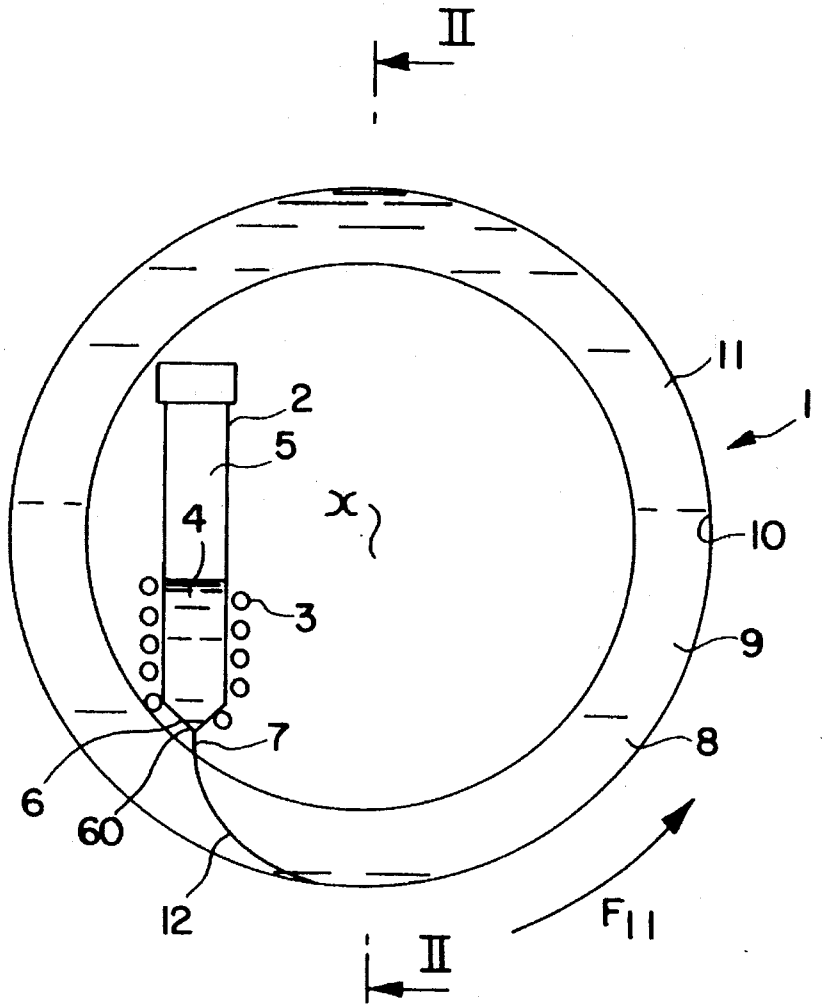
FIG. 1 shows a device in accordance with the invention, with a rotary drum, in a sectional view taken in a plane perpendicular to the axis of the drum.

FIGS. 1 and 2 show a device 1 in accordance with the invention for the production of amorphous metal wires made of iron-based alloys. This device 1 comprises a crucible 2 around which is situated the induction coil 3 which makes it possible to melt the iron-based amorphizable metal alloy 4 contained in the crucible 2, a pressurized gas 5, for example helium, making it possible to cause the liquid alloy 4 to flow through the orifice 60 of the die 6 so as to obtain a jet 7, this gas 5 being inert to the alloy 4.

This jet 7, directed, for example, downward, reaches the layer 8 of cooling liquid 9, this layer being held against the inner wall 10 of the drum 11, this liquid 9 being, for example, water. The jet 7 then solidifies very rapidly to give the amorphous metal wire 12.

The drum 11 driven by the motor 13 turns about its axis in the direction of the arrow $F_{11}$, this axis being given reference xx' in FIG. 2 and x in FIG. 1. The centrifugal force thus obtained applies the liquid 9 in the form of a cylindrical uniform layer 8 against the inner wall 10, as indicated above. FIG. 1 is a section made according to a plane perpendicular to the axis xx', and FIG. 2 is a section made according to a plane passing through the axis xx', the reference to this plane being given by the straight line segments II—II in FIG. 1.

Figure 3:
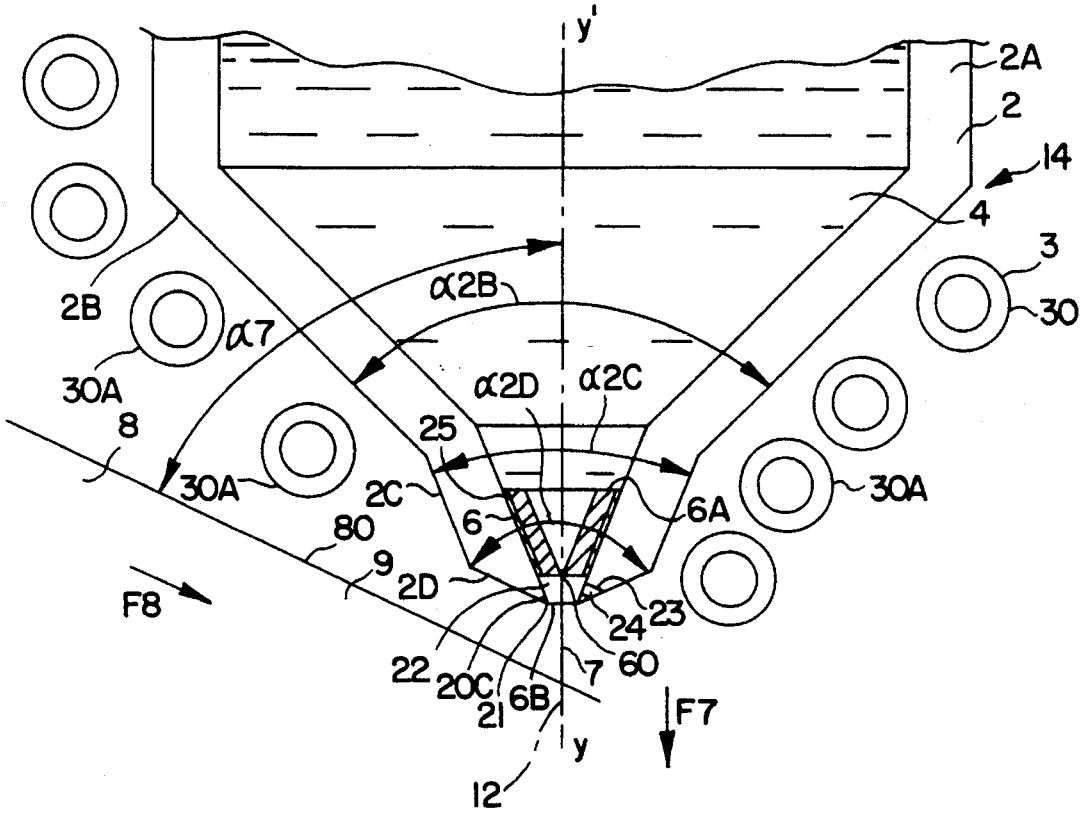
FIG. 3 shows a part of the device shown in FIGS. 1 and 2, in greater detail, with a part of the crucible and the die employed in this device, in a sectional view taken in a plane containing the axis of the crucible and of the die and perpendicular to the axis of the drum.

FIG. 3 shows a part 14 of the device 1 in greater detail, FIG. 3 being a section similar to that of FIG. 1, and therefore perpendicular to the axis xx'. This part 14 shows the lower part of the crucible 2, the die 6 with its orifice 60, and the lower turns of the coil 3, as well as the free surface 80 of the liquid layer 8.

The crucible 2 comprises an upper cylindrical part 2A, an intermediate part 2B forming a part of a cone, and a lower part 2C, also in the form of a cone, ending in a conical beveled face 2D which defines an opening 21 in its lower part.

The crucible 2 has an axis of revolution, given reference yy', for example vertical, which is also the axis of revolution of the die 6 and of its orifice 60, this axis yy' being included in the plane of FIG. 3. The thickness of the crucible 2 is practically constant in the case of the parts 2A, 2B, and the thickness of the part 2C corresponding to the beveled face 2D decreases toward the bottom. The angles of the conical parts 2B, 2C, measured at the outer surface of the crucible 2, are referred to as α2B, α2C, respectively. The angle of the conical face 2D is referred to as α2D. The jet 7 flows downward, along the axis yy', from the orifice 60, through the opening 21, in the direction of the surface 80 of the layer 8, this flow being shown diagrammatically by the arrow F7, and it forms the acute angle α7 with the surface 80, in the plane of FIG. 3, this surface 80 being driven in a rotational motion, shown diagrammatically by the arrow F8. The arrows F7, F8 are situated in the plane of FIG. 3 and between them they form the angle α7, which is the angle of incidence of the jet 7 in relation to the circumferential direction of rotation of the liquid 9. The upper face 6A of the die 6 is planar and forms a crown, and the lower face 6B of the die 6 is also planar, being pierced by the orifice 60.

The die 6 is arranged inside the conical part 2C of the crucible. A portion of the inner face of the part 2C, referred to as 20C, the lower outer face 6B of the die 6 where the orifice 60 is situated, and the opening 21 define a chamber 22 into which emerges a fine tube 23 passing through the beveled face 2D. During the pouring of the alloy 4 a neutral or reducing gas 24 is delivered through the tube 23. This gas 24 fills the chamber 22, while being in contact with the face 6B and therefore with the jet 7, as it leaves the orifice 60. The gas 24 flows slowly out of the chamber 22 through the opening 21. The gas 24 may be, for example, nitrogen, argon, hydrogen, cracked ammonia, hydrogen or a mixture containing hydrogen being preferred, pure hydrogen being still more preferable.

A joint 25 sandwiched between the die 6 and the crucible 2 ensures leakproofing between these two components. The die 6 and the crucible 2 are made of different materials making it possible to meet the different requirements in the case of the die 6 and the crucible 2. The material of the joint 25 differs from the materials employed for the die 6 and the crucible 2.

The coil 3 is made up of a single spiral winding around the axis yy' of a fine copper tube 30 cooled internally by water circulation, forming turns 30A which are inclined in relation to the axis yy' (FIGS. 2 and 3) and which follow the conical parts 2B, 2C and the cylinder 2A at a short distance. To make the drawing simple, only four turns 30A are shown in FIG. 3. The lower turn 30A, that is to say the one nearest to the surface 80, is, for example, situated practically in a plane parallel to the surface portion 80 which faces it, this lower turn descending to the level of the orifice 60 while following the axis yy'. The chamber 22 is small in relation to the crucible 2 and to the die 6.

The beveled face 2D of the lower part 2C makes it possible to have a small height for the chamber 22 and a small distance between the orifice 60 and the surface 80. The angle α2D of this beveled face 2D is, for example, equal to twice the angle α7 or close to twice the angle α7, for this purpose.

The opening 21 preferably has a diameter of between 1 mm and 2 mm.

The invention makes possible the following advantages:

a) The use of different materials for the crucible 2 and the die 6 makes it possible to meet the different requirements presented by these components.

Given its volume, the crucible 2 must be made of a material the cost of which is not high and which makes it possible to withstand thermal shocks and high thermal gradients while being inert to the liquid alloy. Such a material is, for example, vitreous silica, the crucible being produced especially by hot drawing.

The die 6 must be highly inert to the liquid alloy, that is to say it must resist a mechanical erosion due to the liquid alloy, and therefore to its dissolving in this alloy, and it must furthermore resist reduction by the active components of the liquid alloy. In the case of amorphizable alloys with a high silicon and boron content, which is often the case, the material of the die may be, for example, a zirconia stabilized in cubic form, especially a zirconia stabilized with at least one of the following compounds: yttrium oxide, magnesia, lime, which thus guarantees a long period of use. It is furthermore possible to produce the die by molding and sintering so as to ensure a perfect reproducibility of its internal profile.

Since these materials are of different kinds, it is necessary to join them using a joint 25 which can be made with a material that is sufficiently fluid at the working temperature to stand up to the problems of differential expansion between the crucible 2 and the die 6, but sufficiently viscous at the working temperature to ensure leakproofing against the liquid alloy 4 under pressure. The material of the joint 25 is, for example, a powder consisting of a mixture of silica and boron oxide.

b) The general form of the pouring portion 14, with the die 6 being set into the lower part of the crucible 2, makes it possible simultaneously to obtain the following advantages:

the die 6 can be heated at the actual orifice 60, and this makes it possible to avoid an overheating of the alloy 4;

the distance covered by the jet 7 between the orifice 60 and the surface 80 of the liquid 9 can be short, preferably not exceeding 15 mm, and advantageously not exceeding 5 mm, this distance being at least equal to 2 mm, the presence of the protective gas 24 nevertheless allowing greater flexibility in the adjustment of this distance than if this gas were not there. This short distance prevents any beginning of breaking up of the jet into droplets and does so while making it possible to work, if desired, with a relatively low value of the angle $\alpha 7$, which often guarantees a good continuity of the wire 12. The value of $\alpha 7$ is preferably between 40° and 90°, this value being more preferably between 50° and 70°.

the localization of the gas 24 in contact with the die 6, around the orifice 60 and the jet 7, allows the face 6B of the die 6 to be protected efficiently against being wetted by the oxide which would form on the jet 7 in the absence of this protection, and therefore to increase its lifetime, while avoiding the oxidation of the alloy 4 of the jet 7, this being with a very low flow rate of gas 24. This flow rate is preferably between 0.5 $cm^3/s$ and 5 $cm^3/s$.

c) All these characteristics have the advantage of permitting the use of iron-rich amorphizable alloys 4, that is to say ones that are economical and give very strong wires, whereas such alloys could not be employed hitherto.

The alloy 4 preferably corresponds to the formula $Fe_\alpha Cr_\beta Si_\gamma B_\delta Ni_\epsilon Co_\zeta Mo_\eta$, this alloy being devoid of other elements, except for the unavoidable impurities.

$\alpha$, $\beta$, $\gamma$, $\delta$, $\epsilon$, $\zeta$ and $\eta$ are the atomic percentages of the elements to which they refer, these percentages having the following relationships:

$$\alpha \geq 55;\ 5 \leq \beta \leq 10;\ 7.5 \leq \gamma \leq 15;\ 8 \leq \delta \leq 15;\ 0 \leq \epsilon + \zeta \leq 15;\ 0 \leq \eta \leq 2.$$

More preferably, there is also at least one of the relationships:

$$\alpha \geq 60;\ 5 \leq \beta \leq 7;\ 0 \leq \epsilon + \zeta \leq 10.$$

The iron content of this alloy is therefore very high, since it is higher than 60% (atomic %). These alloys are economical and the invention enables them to be employed to produce great lengths of amorphous wires, without break, these wires having advantageous mechanical properties, whereas the known processes did not allow them to be employed because they resulted in frequent breakages and in wires exhibiting poor mechanical properties.

EXAMPLES

In the two examples in accordance with the invention which follow, the device 1 is employed for producing amorphous wires 12 with the aid of two amorphizable alloys. To produce these two examples the device 1 has the following characteristics:

internal diameter of the drum 11: 470 mm;

fluid 9 employed: water; thickness of the layer 8: 20 mm; water temperature: 5° C.; the surface 80 of the layer 8 is at atmospheric pressure;

angle $\alpha 7$: 52°;

gas 5: helium, pressure of this gas: 4.5 bars (450,000 Pa);

distance between the orifice 60 of the die 6 and the free surface 80 along the axis yy': 3 mm;

protective gas 24: hydrogen; flow rate of this gas 24 at a pressure of 1 bar and ambient temperature (approximately 20° C.), 2.22 $cm^3/s$, that is a velocity of 280 cm/s in the tube 23;

crucible 2 made of transparent vitreous silica; thickness of the crucible 2 in the parts 2A, 2B and 2C (before the beveled face 2D), approximately 3 mm; angle $\alpha 2B$: approximately 90° ; angle $\alpha 2C$: approximately 35°; angle $\alpha 2D$: approximately 120°;

die 6 made of zirconia stabilized with yttrium oxide by a molding technique using uniaxial compression and sintering, thickness of this die: approximately 1 mm; height along the axis yy': approximately 5 mm; inside and outside this die is in the form of a cone whose angle (no reference shown) is equal to $\alpha 2C$, that is approximately 35°;

joint 25 made of a mixture of silica and boron oxide;

height of the chamber 22 along the axis yy': approximately 2 mm; diameter of the opening 21: approximately 1 mm.

Example 1

An amorphizable alloy of composition $Fe_{61}Co_{10}Cr_7Si_9B_{13}$ is employed, the subscript figures giving the atomic percentages.

The spinning is performed in the following conditions:

temperature of the liquid alloy: 1250° C.;

diameter of the orifice 60: 110 μm;

linear velocity of the inner wall 10 of the drum 11: 9.04 m/s.

A continuous length of 1760 m is obtained of amorphous wire 12 which has a diameter of 98 μm and a mean tensile breaking load, in the crude quench state, of 3237 MPa with a standard deviation of 59.

Example 2

An amorphizable alloy of composition $Fe_{71}Cr_7Si_9B_{13}$ is employed, the subscript figures giving the atomic percentages.

The spinning is performed in the following conditions:

temperature of the liquid alloy: 1260° C.;

diameter of the orifice 60: 118 μm;

linear velocity of the inner wall 10 of the drum 11: 9.33 m/s.

A continuous length of 1145 m is obtained of amorphous wire 12 which has a diameter of 109 μm and a mean tensile breaking load, in the crude quench state, of 3219 MPa with a standard deviation of 38.

Figure 4:
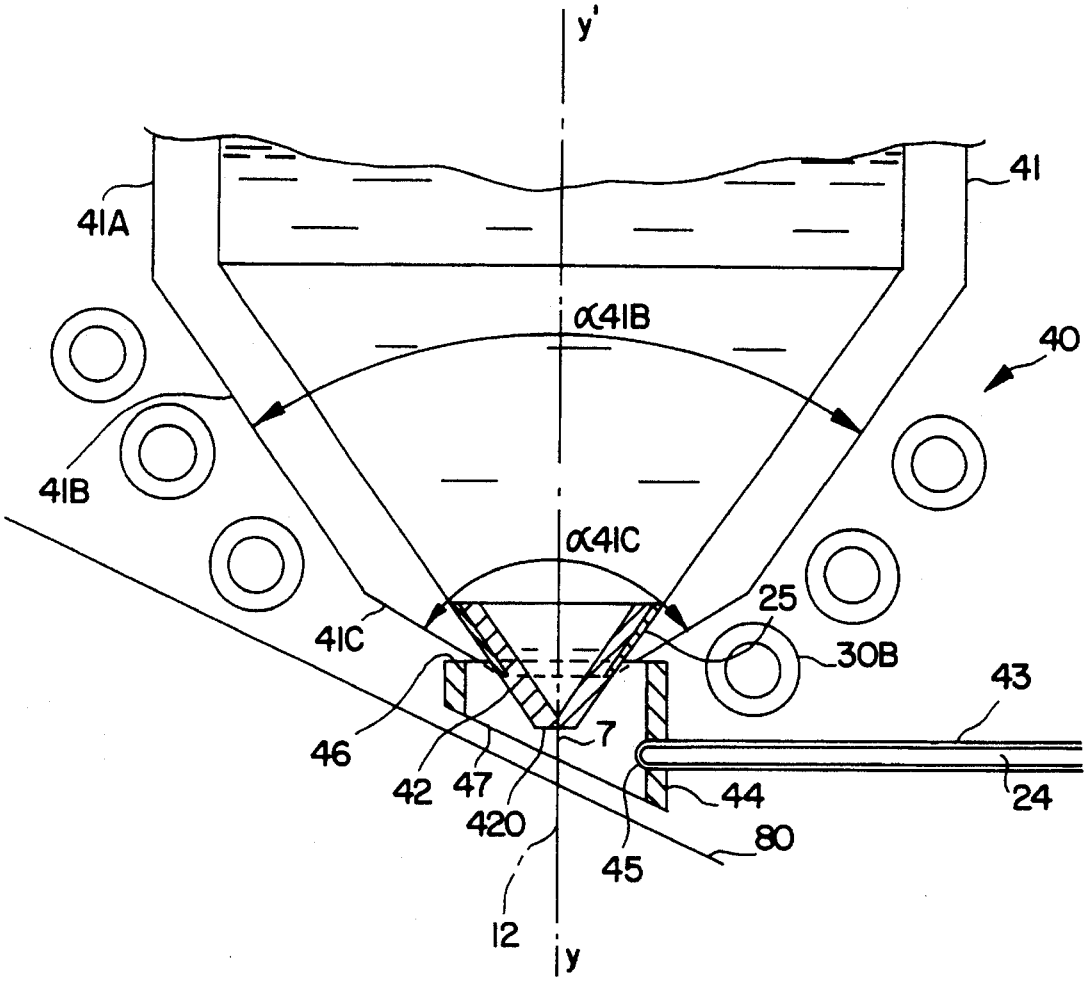
FIG. 4 shows a part of another device in accordance with the invention, this figure being a section similar to that of FIG. 3.

FIG. 4 shows a part of another device 40 in accordance with the invention. This device 40 is similar to the device 1, with the following differences. In this device 40 the crucible 41 comprises a cylindrical upper part 41A, similar to the part 2A of the device 1. This part 41A is extended downward by a conical part 41B whose lower end has a beveled face 41C, also conical. The angles of the cones of the part 41B and of the face 41C are denoted by α41B and α41C respectively.

The die 42 has a form similar to the die 6 of the device 1, but is situated in the lower portion of the part 41B, so that its orifice 420 is situated outside and below the crucible 41, the die 42 thus projecting out of the conical part 41B, outside the crucible 41.

The part of the die 42 which is under the part 41B of the crucible 41 is surrounded by a ring 44 pierced with a hole 45 accommodating the tube 43 through which the gas 24 is delivered into the ring 44. Externally, this ring 44 is, for example, in the form of a portion of a cylinder whose upper end 46 is secured in a leakproof manner to the beveled face 41C while surrounding the orifice 420, whereas its lower end 47 is practically parallel to the portion of surface 80 which faces it, and at a short distance from this portion. In this arrangement the angle α41B is, for example, smaller than the angle α2B of the device 1.

The device 40 makes it possible to localize the gas 24 around the lower part of the die 42 against the orifice 420, and around the jet 7, in the chamber formed by the inner face of the ring 44 and by the portions of surface 41C and of die 42 which it surrounds.

The material of the ring 44 may be, for example, the same as that of the crucible 41.

Of course, the invention is not limited to the examples described above. Thus, for example, the geometric characteristics given above, especially in the case of the angles and the thicknesses of the crucible 2 and of the die 6, may vary within wide limits.

We claim:

1. A process for producing a wire made of amorphous metal alloy having an iron base, this process producing a jet of a molten amorphizable alloy through the orifice of a die and introducing the jet into a cooling liquid urged by centrifugal force against the inner wall of a rotary drum, this process comprising the steps of:

(a) accommodating the alloy in a crucible having a die arranged at one end of the crucible, the crucible and the die being made of different materials joined by a joint the material of which differs from the materials of the crucible and of the die;

(b) heating the alloy both in the crucible and in the die by the same heating means; and (c) delivering an inert or reducing gas directly in contact with the jet as it leaves the die.

2. A process according to claim 1, characterized in that the crucible comprises at least one conical part with an opening through which the jet passes, the die being arranged at least partly in this conical part.

3. A process according to claim 2, characterized in that the die is arranged entirely in the conical part, this conical part and the outermost face of the die, where the orifice of the latter is situated, defining a chamber into which there emerges a tube through which the gas is delivered into the chamber, this chamber comprising an opening through which the jet passes, as it moves toward the cooling liquid.

4. A process according to claim 2, characterized in that the die is arranged only partly in the conical part and projects, with its orifice, out of this conical part, outside the crucible; a tube enabling the gas to be delivered directly in contact with the jet, as it leaves the die, emerges into a chamber surrounding the die orifice, this chamber comprising an opening through which the jet passes as it moves torward the cooling liquid.

5. A process according to claim 4, characterized in that the chamber is made partly using vitreous silica.

6. A process according to claim 1, characterized in that the crucible is made of vitreous silica.

7. A process according to claim 1, characterized in that the die is made of zirconia stabilized in cubic form.

8. A process according to claim 7, characterized in that the die is made of zirconia stabilized with at least one of the following compounds: yttrium oxide, magnesia, lime.

9. A process according to claim 1, characterized in that the joint is made using a mixture of silica and boron oxide.

10. A process according to claim 1, characterized in that an alloy of formula is employed, $Fe_\alpha Cr_\beta Si_\gamma B_\delta Ni_\epsilon Co_\zeta Mo_\eta$ is employed, of the elements to which they refer, these percentages having the following relationships:

α, β, γ, δ, ε, ζ and η being the atomic percentages of the elements to which they refer, these percentages having the following relationships:

$$\alpha \geqq 55;\ 5 \leqq \beta \leqq 10;\ 7.5 \leqq \gamma \leqq 15;\ 8 \leqq \delta \leqq 15;\ 0 \leqq \epsilon + \zeta \leqq 15;\ 0 \leqq \eta \leqq 2.$$

11. A process according to claim 10, characterized in that there is at least one of the relationships:

$$\alpha \geqq 60;\ 5 \leqq \beta \leqq 7;\ 0 \leqq \epsilon + \zeta \leqq 10.$$

12. A process according to claim 1, characterized in that the distance covered by the jet between the die orifice and the cooling liquid is at least 2 mm and not more than 15 mm.

13. A process according to claim 12, characterized in that this distance is at least 2 mm and not more than 5 mm.

14. A process according to claim 1, characterized in that the contact of the jet with the cooling liquid takes place at an angle of incidence of between 40° and 90° in relation to the circumferential direction of rotation of the liquid, the angle of incidence being the angle formed by the intersection between the incident jet direction and the circumferential rotation of the liquid.

15. A process according to claim 14, characterized in that this angle of incidence is between 50° and 70°.

16. A device for producing a wire made of amorphous metal alloy having an iron base, this device comprising a crucible containing an amorphizable alloy in the liquid state having an iron base, a die arranged at one end of the crucible, means enabling a pressure to be applied to make the liquid alloy flow through the die orifice, in the form of a jet, toward a cooling liquid, a drum, and means enabling the drum to be rotated about an axis so as to urge the cooling liquid in the form of a layer against the inner wall of the drum, thereby forming the amorphous wire by rapid solidification of the jet, the device comprising:

a) a crucible and a die produced using different materials and joined by a joint the material of which differs from those of the crucible and of the die;

b) means which are the same for heating the alloy both in the crucible and in the die; and c) means for delivering an inert or reducing gas directly in contact with the jet as it leaves the die.

17. A device according to claim 16, characterized in that the crucible comprises at least one conical part with an opening through which the jet passes, the die being arranged at least partly in this conical part.

18. A device according to claim 17, characterized in that the die is arranged entirely in the conical part, this conical part and the outermost face of the die where the orifice of the latter is situated, defining a chamber, the means for delivering the gas comprising a tube which emerges into this chamber so as to deliver the gas into the chamber, the chamber comprising an opening for the passage of the jet in the direction of the cooling liquid.

19. A device according to claim 17, characterized in that the die is arranged only partly in the conical part and projects, with its orifice, out of this conical part, outside the crucible, the means for delivering the gas comprising a tube which emerges into a chamber surrounding the die orifice, the chamber comprising an opening for the passage of the jet, in the direction of the cooling liquid.

20. A device according to claim 19, characterized in that the chamber is partly made of vitreous silica.

21. A device according to claim 16, characterized in that the crucible is made of vitreous silica.

22. A device according to claim 16, characterized in that the die is made of zirconia stabilized in cubic form.

23. A device according to claim 22, characterized in that the die is made of zirconia stabilized with at least one of the following compounds: yttrium oxide, magnesia, lime.

24. A device according to claim 16, characterized in that the joint is a mixture of silica and boron oxide.

25. A device according to claim 16, characterized in that it is arranged so that the distance capable of being covered by the jet between the die orifice and the cooling liquid is at least 2 mm and not more than 15 mm.

26. A device according to claim 25, characterized in that this distance is at least 2 mm and not more than 5 mm.

27. A device according to claim 16, characterized in that it is arranged so that the contact of the jet with the cooling liquid takes place at an angle of incidence of between 40° and 90° in relation to the circumferential direction of rotation of the liquid, the angle of incidence being the angle formed by the intersection between the incident jet direction and the circumferential rotation of the liquid.

28. A device according to claim 27, characterized in that this angle of incidence is between 50° and 70°.

* * * * *

UNITED STATES PATENT AND TRADEMARK OFFICE

CERTIFICATE OF CORRECTION

PATENT NO. : 5,477,910
DATED : Dec. 26, 1995
INVENTOR(S) : Bijaoui et al.

It is certified that error appears in the above-indentified patent and that said Letters Patent is hereby corrected as shown below:

Col. 8, line 24, "formula is employed," should read --formula--;

lines 25-26, "employed, of the elements to which they refer, these percentages having the following relationships:" should read --employed--.

Signed and Sealed this

Fourth Day of June, 1996

Bruce Lehman

*Attest:*

BRUCE LEHMAN

*Attesting Officer*

*Commissioner of Patents and Trademarks*